US006238251B1

(12) United States Patent
Curtis et al.

(10) Patent No.: US 6,238,251 B1
(45) Date of Patent: May 29, 2001

(54) PATCH PANEL WITH PATCH CORD PLUG KEYWAY

(75) Inventors: Dennis W. J. Curtis, Norcross, GA (US); Leonard H. Drexler; Ronald L. Wild, both of Carmel, IN (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/222,749

(22) Filed: Dec. 29, 1998

(51) Int. Cl.[7] ..... H01R 13/64; H01R 13/625

(52) U.S. Cl. ..... 439/680; 439/954; 439/439; 439/344

(58) Field of Search ..... 439/680, 344, 439/352, 354, 573, 108, 374, 540.1, 542, 954

(56) References Cited

U.S. PATENT DOCUMENTS 4,990,094 * 2/1991 Chandler et al. ..... 439/108
5,118,311 * 6/1992 Margini ..... 439/676
5,748,595 * 5/1998 Nakajima ..... 369/77.2
5,906,517 * 5/1999 Crane et al. ..... 439/654

* cited by examiner

*Primary Examiner*—Brian Sircus
*Assistant Examiner*—Chandrika Prasad
(74) *Attorney, Agent, or Firm*—Thomas, Kayden, Horstemeyer & Risley, LLP

(57) ABSTRACT

A patch panel with patch cord plug keyway incorporates at least one jack. The jack communicates with a transmission medium, such as a cable, with the jack including a plug-receiving cavity and a keyway. The plug-receiving cavity is configured to receive and securely mount the plug of a patch cord so that the transmission medium cooperating with the jack electrically communicates with the patch cord when the plug is in an engaged position. The keyway is formed through the jack and communicates with the plug-receiving cavity. Additionally, the patch cord plug incorporates a key which engages the keyway of the jack. So configured, the key assists a technician in aligning the patch cord plug with the plug-receiving cavity of a jack during patching operations. In a preferred arrangement, they key is formed on a rotatable lever which places the plug in a locking and unlocking orientation.

19 Claims, 9 Drawing Sheets

PATCH PANEL WITH PATCH CORD PLUG KEYWAY

BACKGROUND OF THE INVENTION

1. Field of the Invention

The present invention relates to patch panels for communications use and, more particularly, to modular connector patch panels which direct patch cord cordage toward the mounting surfaces to which the patch panels are mounted.

2. Description of the Related Art

In buildings and, more particularly, within communications connection closets in buildings, various transmission media typically are connected to each other and to incoming and outgoing lines by means, such as connectors, which are mounted to patch panels. Patch panels generally are mounted within a communications closet, such as to a wall or other mounting surface, and incorporate a series of connectors for interconnecting the various transmission media. Transmission media, such as copper wires formed into patch cords, for instance, often incorporate plugs at their ends. These plugs are configured for mating with, for example, the plug-receiving cavities of jacks, which commonly serve as connectors for mounting within a patch panel.

Heretofore, it has been commonplace to orient patch panel jacks within a patch panel so that the plug-receiving cavities of the jacks face forward, e.g. away from the mounting surface to which the patch panel is mounted. So configured, the plugs of patch cords typically have an insertion direction into the plug-receiving cavity of a patch panel jack that is perpendicular with and toward the mounting surface of the patch panel, thereby providing a technician with convenient access for connecting the plugs to and removing the plugs from the various jacks. Since patch cord cordage typically extends from a patch cord plug in a direction which is approximately 180 degrees from its insertion direction, the aforementioned patch panel configuration presents patch cord cordage which extend away from the patch panel jacks and the patch panel mounting surface. The cordage then tend to hang downwardly in front of the patch panel. When carefully dressed, the cordage appear neat and orderly and can facilitate efficient patching efforts by a technician, because the patch cords and the patch panel jacks are readily accessible. However, when patch cord cordage are not carefully dressed, a general appearance of disorder can result as the cordage inherently tend to form loops in front of the patch panel jacks. In extreme cases, the cordage may become entangled or snarled with adjacent cables, thereby potentially hindering a technician's patching efforts.

Therefore, there is a need to provide an improved patch panel which addresses these and other shortcomings of the prior art.

BRIEF SUMMARY OF THE INVENTION

Certain objects, advantages and novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

The present invention is generally directed to an improved patch panel incorporating at least one jack which is adapted to cooperate with a patch cord plug. The jack communicates with a transmission medium, such as a cable, with the jack including a plug-receiving cavity and a keyway. The plug-receiving cavity is configured to receive and securely mount the plug of a patch cord so that the transmission medium cooperating with the jack electrically communicates with the patch cord when the plug is in an engaged position within the plug-receiving cavity. The keyway is formed through the jack and communicates with the plug-receiving cavity. Additionally, the patch cord plug incorporates a key which engages the keyway of the jack. So configured, the key assists a technician in aligning the patch cord plug with the plug-receiving cavity of a jack during patching operations.

In preferred embodiments, the patch panel incorporates jacks which are oriented with their plug-receiving cavities oriented toward the mounting surface to which the panel is mounted. The jacks receive patch cord plugs which are inserted into the plug-receiving cavities of the jacks in an insertion direction which is oriented away from the mounting surface, thereby allowing the cordage of the patch cords to extend away from the jacks and toward the mounting surface. So configured, the cordage no longer tend to hang downwardly in front of the jacks of the panel.

In accordance with another aspect of the present invention, preferred embodiments of a patch cord plug utilized with the improved patch panel incorporate a latch and a lever. The latch is movable between a locking position for securing the plug within the plug-receiving cavity of a jack, and an unlocking position for allowing the plug to be removed from the plug-receiving cavity. The lever is movable between a disengaged position and an engaged position such that moving the lever to the engaged position urges the latch to its unlocking position. Some embodiments of the plug incorporate a flexible section with the flexible section being deformable between an unflexed position, corresponding to the disengaged position of the lever, and a flexed position, corresponding to the engaged position of the lever. In other embodiments, the plug can incorporate an axle, with the lever being rotatable about the axle between its disengaged position and its engaged position. Additionally, preferred embodiments of the plug can include protrusions extending from the side walls of the lever and which are configured to engage the bottom wall of a jack, thereby assisting a technician in aligning the patch cord plug with the plug receiving cavity of a jack during patching operations.

Other features and advantages of the present invention will become apparent to one with skill in the art upon examination of the following drawings and detailed description. It is intended that all such additional features and advantages be included herein within the scope of the present invention, as defined by the claims.

BRIEF DESCRIPTION OF THE SEVERAL VIEWS OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE PREFERRED EMBODIMENT

Figure 1:
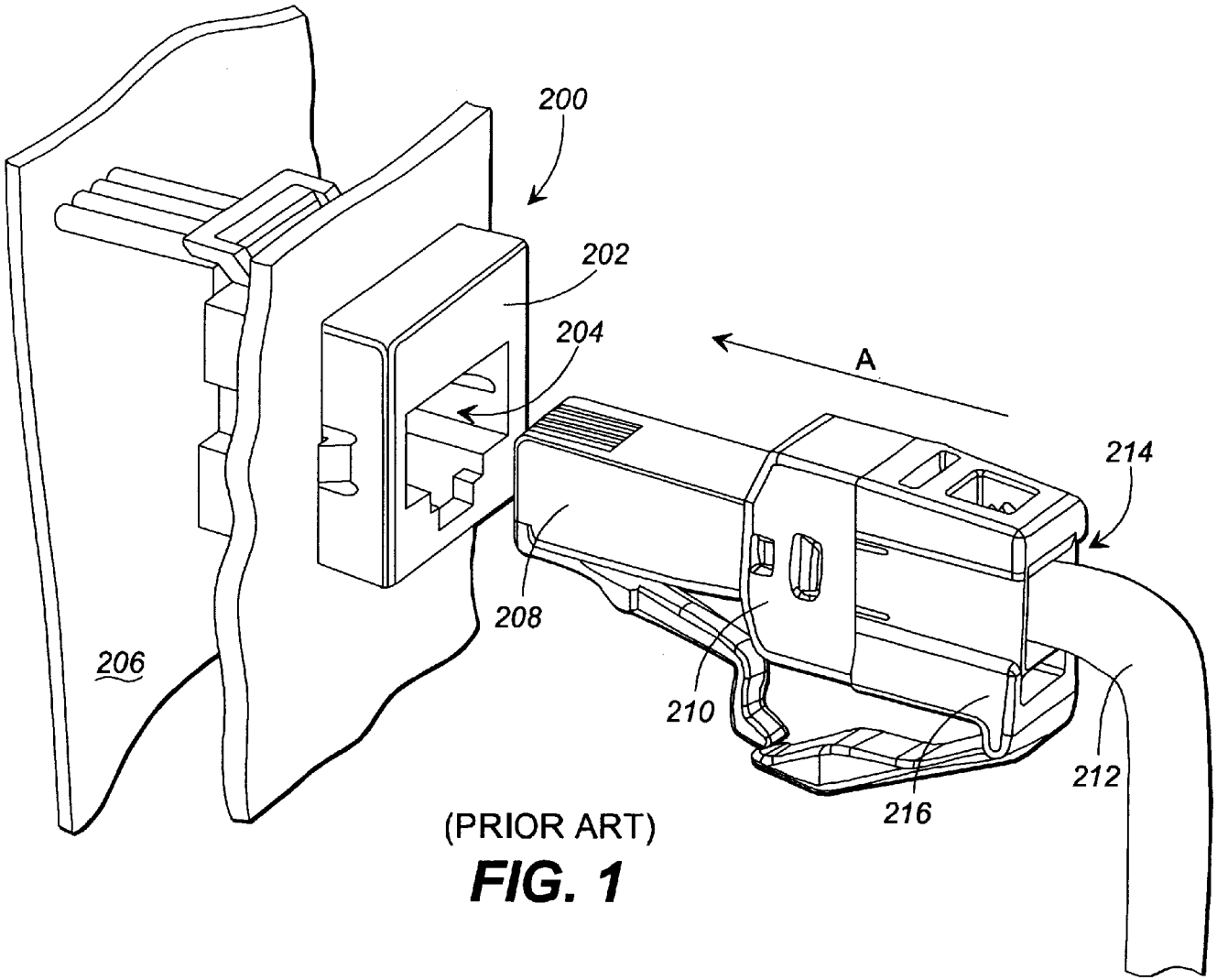
(PRIOR ART) FIG. 1
FIG. 1 is a partially cut-away, partially exploded, perspective view of a prior art patch panel showing detail of a jack and patch cord plug.

Reference will now be made in detail to the description of the invention as illustrated in the drawings, wherein like reference numbers indicate like parts throughout the several views. FIG. 1 shows a representative portion of a typical prior art patch panel 200. Prior art patch panel 200 incorporates a plurality of jacks 202 (one of such jacks being shown in FIG. 1) for interconnecting a series of transmission media, such as cables, patch cords, etc. Jack 202 incorporates a plug-receiving cavity 204 and is arranged within its panel 200 so that the plug-receiving cavity 204 faces away from patch panel mounting surface 206, i.e. a wall. Cavity 204 is adapted to engage the front end 208 of a plug 210 when the front end 208 of the plug is inserted into cavity 204 in direction A. Plug 210 electrically communicates with cordage 212 which engages the plug through a cordage-receiving cavity 214 arranged at the rear end 216 of the plug. So configured, cordage 212 extends away from jack 202 and away from mounting surface 206 when plug 210 is engaged within the plug-receiving cavity 204 of jack 202 (e.g. in a direction opposite to that of the insertion direction A).

As described hereinabove, the cordage 212 of adjacent patch cords which are connected to a prior art patch panel may become entangled as the cordage extend in front of and hang below their respective jacks. Thus, the prior art patch panel 200 may reduce the efficiency of a technician while the technician attempts to perform patching functions and, otherwise, can tend to form a disorderly appearance if the cordage are not properly dressed.

Figure 2:
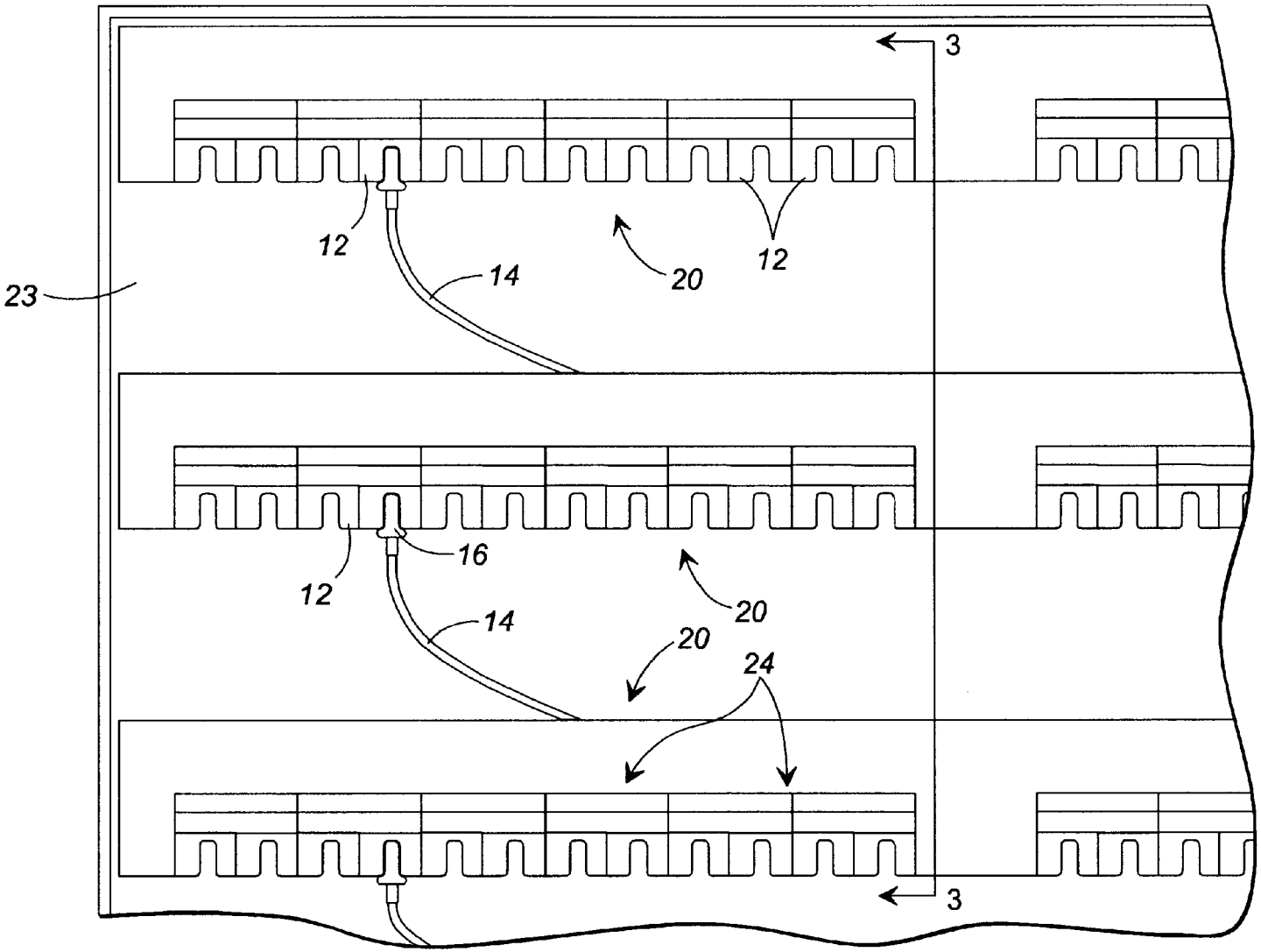
FIG. 2 is a partially cut-away front view of a preferred embodiment of the patch panel of the present invention.
Figure 3:
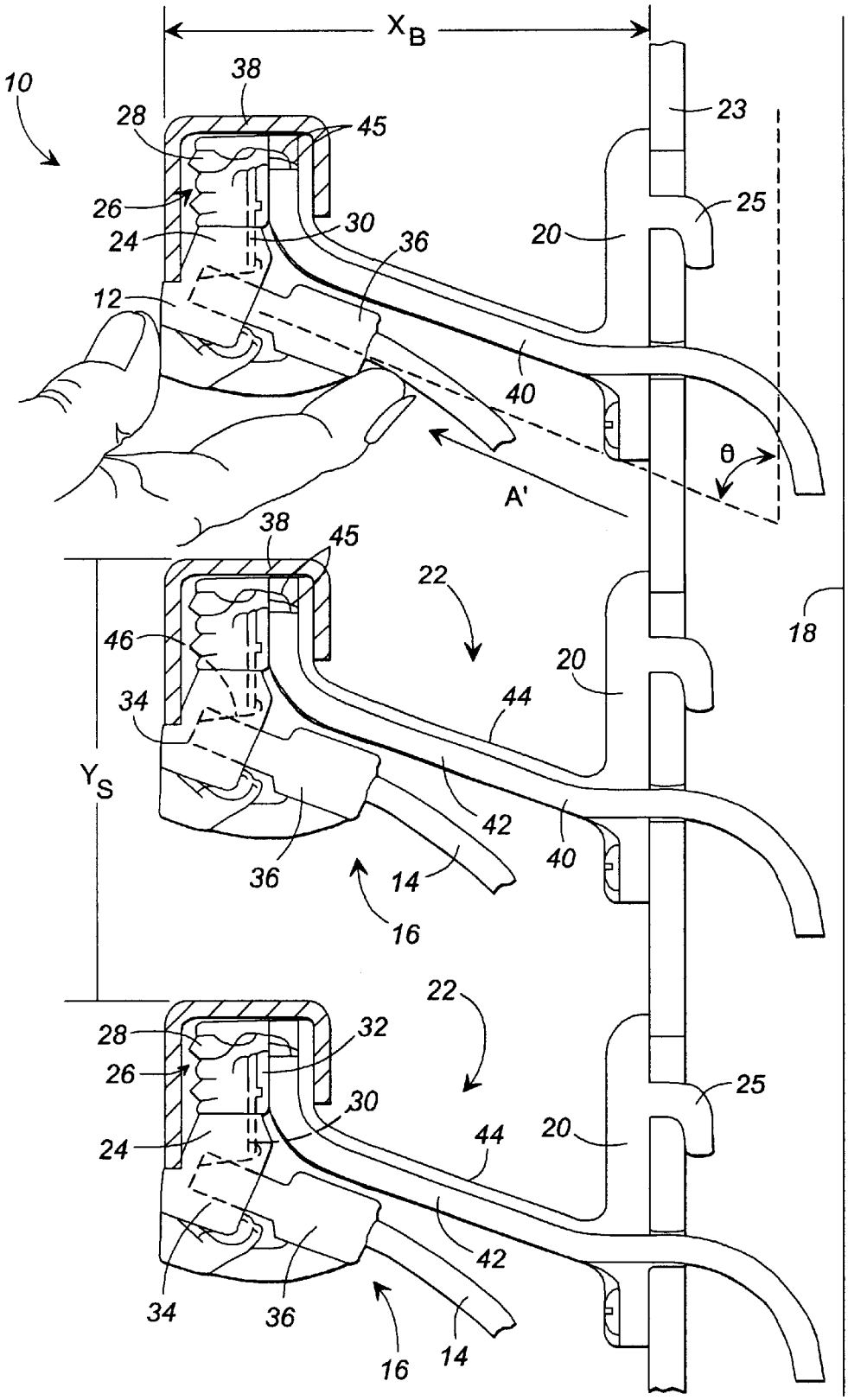
FIG. 3 is a partially cut-away, partially cross-sectional view of the patch panel of FIG. 2 taken along section lines 3—3.
Figure 4C:
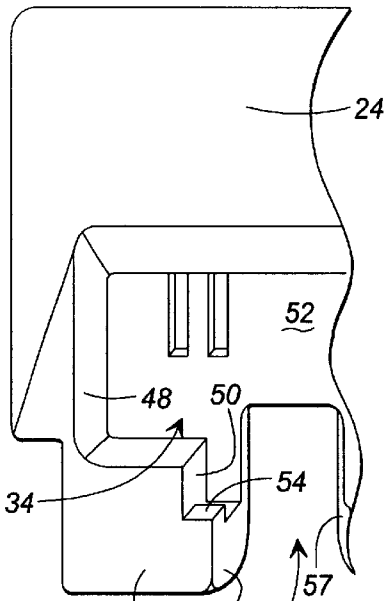
FIG. 4C is a partially cut-away, front view of the embodiment of the patch panel jack of FIGS. 4A and 4B.
Figure 5:
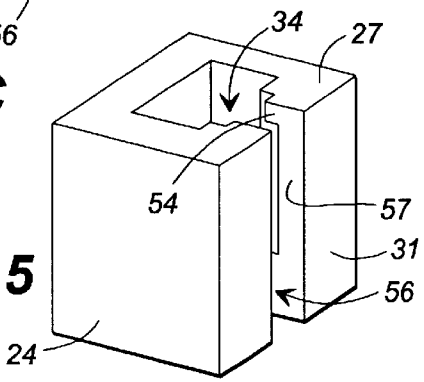
FIG. 5 is a perspective view of an alternative embodiment of the patch panel jack utilized in the present invention, showing detail of the keyway.
Figure 4B:
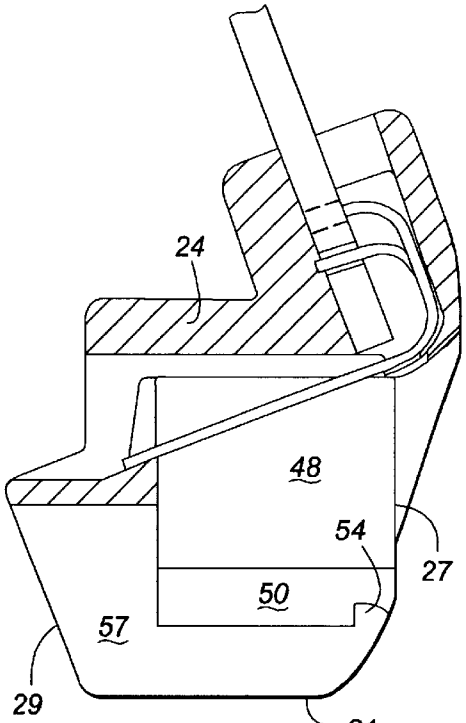
FIG. 4B is a cross-sectional, side view of the embodiment of the patch panel jack of FIG. 4A.
Figure 4A:
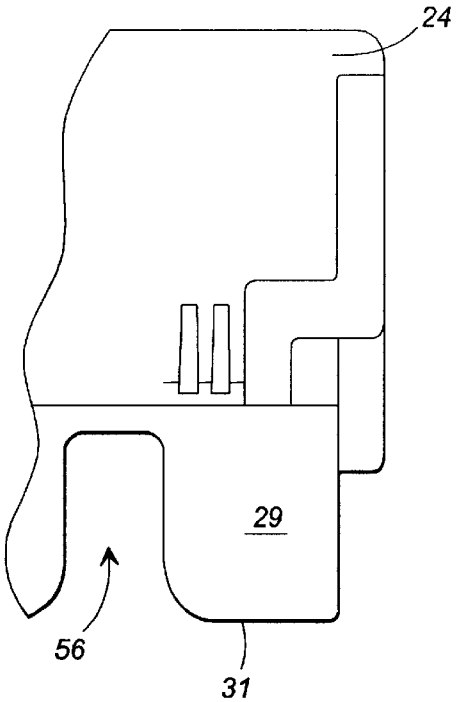
FIG. 4A is a partially cut-away, rear view of a preferred embodiment of the patch panel jack utilized in the present invention.

As shown in FIGS. 2 and 3, a preferred embodiment of the patch panel 10 of the present invention incorporates one or more jacks 12 which are configured to direct the cordage 14 of patch cords 16 toward the mounting surface 18 of the patch panel. Patch panel 10 includes one or more jack mounting brackets 20 which each incorporate a series of jacks 12. For patch panels 10 incorporating more than one mounting bracket 20, the brackets can be spaced vertically from each other in order to form a space or raceway 22 between the upper surface of the lower bracket 20 and the lower surface of the upper bracket 20 for accommodating the passage of cables and cordage therethrough. A vertical spacing ($Y_s$) of approximately 3.2 inches (e.g. a vertical pitch of approximately 3.75 rows per foot) has been found suitable for typical applications. Typically, each bracket 20 extends a length ($X_B$) of approximately 3.5 inches from its mounting surface.

Some embodiments of the patch panel 10 incorporate a housing or frame 23. In these embodiments, jack mounting brackets 20 typically are mounted to the frame 23 with the frame then being mounted to a mounting surface 18. However, for those embodiments which do not incorporate a frame, the mounting brackets 20 typically are fastened directly to a wall or other mounting surface. Attachment of the brackets 20 to a mounting surface is accomplished by any suitable means, including: attaching the brackets with mechanical fasteners, such as screws, bolts, rivets, etc; mating a hanger member 25 (FIG. 3) of each bracket 20 through a corresponding orifice in frame 23; etc.

Referring now to FIG. 3, the assembly of a representative portion of a preferred embodiment of the patch panel 10 will be described in detail. As shown in FIG. 3, each mounting bracket 20 cooperates with at least one jack rack assembly 26. Each jack rack assembly 26 includes a jack frame 24, a punch-down IDC field connection 28, a PWB 30 and, in some embodiments, a mounting plate or chassis 32 for attaching the jack rack assembly to the bracket 20. Each jack frame 24 provides at least one plug-receiving cavity 34 formed therein that is adapted to be engaged by the plug 36 of a patch cord 16. When more than one plug-receiving cavity 34 is provided in a jack frame 24, the plug-receiving cavities preferably are arranged in a side-by-side relationship with each other across the width of each frame 24. In alternative embodiments, multiple plug-receiving cavities 34 are provided by a series of jacks 12 with each jack 12 providing a single plug-receiving cavity 34. The single plug-receiving cavity jacks 12 preferably are arranged in a side-by-side relationship across the width of a bracket 20. Additionally, each bracket 20 can cooperate with a cover 38 which preferably attaches to bracket 20 and jack rack assembly 26 for enclosing and protecting the IDC field connection 28, PWB 30, and other components and electrical connections of jack rack assembly 26. Additionally, each jack frame 24 and, in particular, each plug-receiving cavity 34, is oriented such that when a plug 36 of a patch cord is inserted into a plug-receiving cavity in direction A', the cordage 14 of the patch cord is directed toward the mounting surface. In preferred embodiments of the patch panel 10, the insertion direction A'is arranged such that the angle ($\theta$) between the insertion direction A' and the mounting surface 18 (or alternatively, frame 25, or vertical plane) is between 0 and 180 degrees, preferably between 0 and 90 degrees, and most preferably between 45 and 90 degrees.

As shown in FIG. 3, a transmission medium, such as cable 40, typically extends from a mounting surface 18 and is directed toward jack rack assembly 24. In preferred embodiments, cable 40 passes through a hole in frame 25 and enters a cable channel 42 which is formed though arm portion 44 of mounting bracket 20. Preferably, cable channel 42 is formed on the underside of bracket 20 and is defined by side walls (not shown) which extend from the underside of the bracket. For those embodiments of the bracket not incorporating a cable channel 42, the cable 40 preferably extends along the underside of the bracket 20 toward the jack rack assembly 26. Conductors 45 of cable 40 terminate at the jack rack assembly 26 and are connected to IDC field connection 28 in a conventional manner. Electrical connection of cable 40 to a plug 36 is completed by PWB 30 which electrically interconnects the conductors 45 to spring wires 46 housed within the jack frame 24. Spring wires 46 are adapted to electrically engage a plug 36 inserted into plug-receiving cavity 34.

Referring now to FIGS. 4A–4C and 5, a preferred embodiment of a jack 12 will be described in detail. Jack 12, which preferably is molded from a dielectric material, such as ABS (acrylonitrile butadiene styrene), incorporates a jack frame 24, including front wall 27, rear wall 29 and bottom wall 31. Plug-receiving cavity 34 is formed, in part, by a pair of upper side walls 48, a pair of lower side walls 50, and a back wall 52. A tab 54 extends from each lower side wall 50 and is adapted to engage the latch of a plug 36 to secure the plug within the plug-receiving cavity. Additionally, a slot or keyway 56, bounded by side walls 57, extends through the jack frame 24 and communicates with the plug-receiving cavity 34. Keyway 56 preferably is oriented substantially parallel to the plug-insertion direction A' and is sized and shaped to receive a key (described in detail hereinafter) of a plug.

Figure 6:
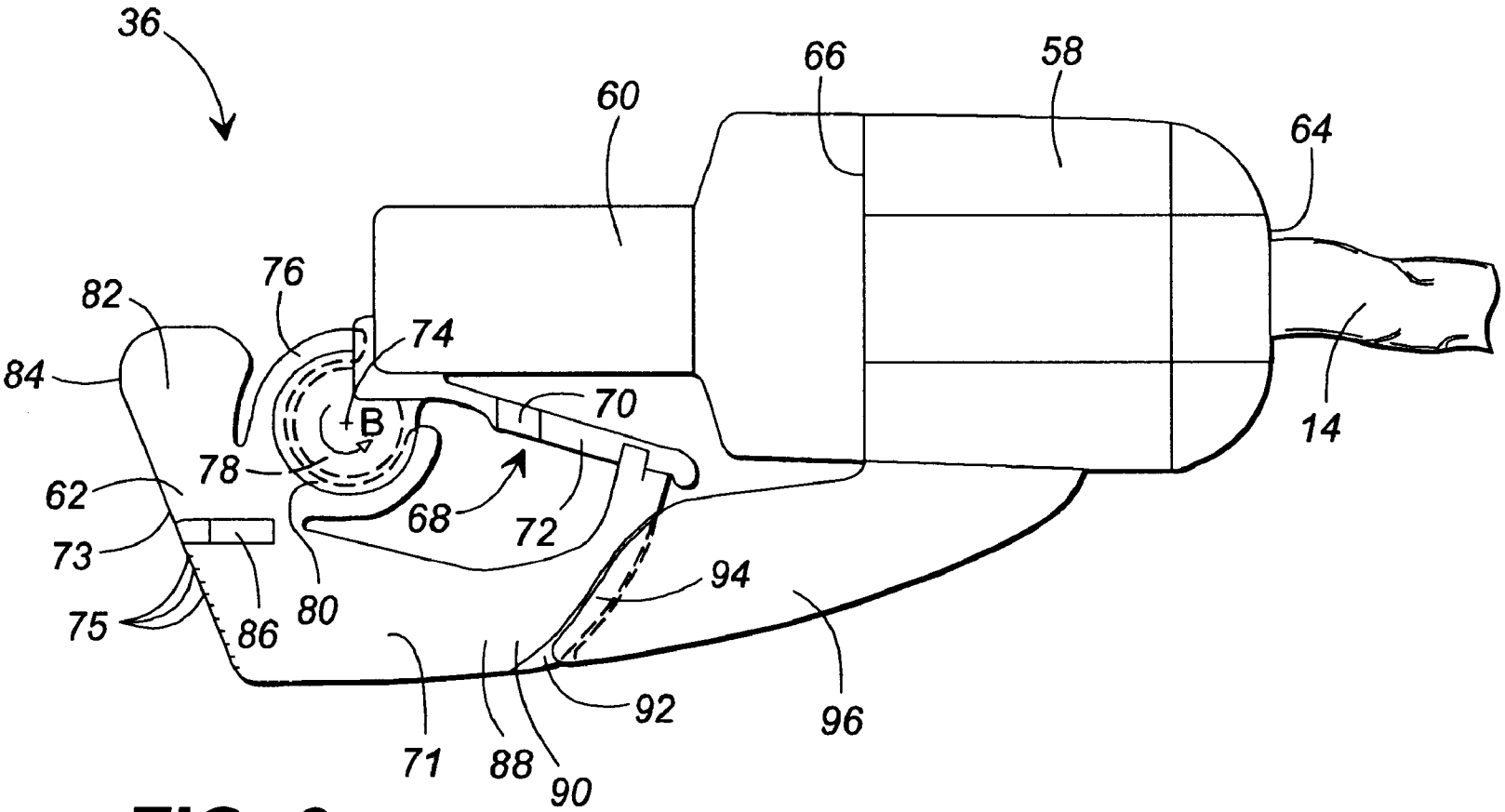
FIG. 6 is a partially cut-away, side view of a preferred embodiment of the patch cord of the present invention, showing detail of the plug.

As shown in FIG. 6, a preferred embodiment of plug 36 incorporates a strain relief housing 58, a jack interface housing 60 and a lever 62. Cordage 14 enters the strain relief housing at its proximal end 64 and then terminates within the plug so that the conductors (e.g. a twisted pair) of cordage 14 can electrically communicate with the spring wires of a jack when the jack interface housing 60 is inserted within the plug-receiving cavity of the jack. Jack interface housing 60 is attached to the distal end 66 of the strain relief housing and provides a resilient latch 68 to secure plug 36 to a jack. When jack interface housing 60 is inserted into a plug-receiving cavity 34, pressure can be applied to latch 68, thereby moving the latch to an unlocking position for easy entry of the interface housing 60 within the plug-receiving cavity 34. Latch 68 then can be released, thereby allowing the latch to return to a locking position so that latch tabs 70, which extend outwardly from latch arm 72, engage behind the tabs 54 (FIGS. 4A–4C) of the jack 12.

Lever 62 includes a pair of side walls 71 (one of which is shown in FIG. 6), and an end wall 73, and provides a rugged handle for use by a technician in grasping and manipulating the plug. End wall 73 also can include a series of grooves 75 for enhancing a technician's grip on the lever. As shown in FIG. 3, preferred embodiments of the lever are configured so that the end wall 73 aligns flush with the front of the panel 10 when the plug 36 is engaged within the plug-receiving cavity of a jack of the panel. The lever is rotatable about an axis 74 by means of bearing 76 which cooperates with an axle 78. Axle 78 is mounted to jack interface housing 60 and preferably incorporates a flange 80 extending radially from each of its ends such that bearing 74 engages the axle between the flanges 80. So configured, lateral deflection of lever 62 is restricted as the bearing 76 contacts the inner surfaces of the flanges 80. A key 82, provided at the distal end 84 of lever 62, is sized and shaped to engage the keyway 56 of a jack. So configured, the key 82 laterally aligns the plug relative to a jack as the plug is inserted into the plug-receiving cavity of the jack. A pair of protrusions 86 arranged adjacent key 82 also can be provided. Protrusions 86 extend outwardly from side walls 71 and are configured for engaging the bottom 31 of a jack (FIGS. 4A–4C) as the plug is inserted into a plug-receiving cavity, thereby further aligning the plug relative to the jack. Additionally, an arm 88 is formed at the proximal end 90 of lever 62. Arm 88 includes an interlock portion 92 for engaging a slot 94 formed in a guide arm 96. Guide arm 96 extends outwardly from strain relief housing 58 and reduces lateral deflection of the arm 90 as the interlock portion 92 slides through slot 94. So configured, plug 36 can be removed from a jack by grasping lever 62 (as shown in FIG. 3, for instance), and rotating the lever counter-clockwise about axis 74 (as indicated by arrow B). Rotation of the lever urges latch 68 toward jack interface housing 60, thereby unlocking the locking tabs 70 from engagement with tabs 54 of the jack. Once the tabs are disengaged, the plug can be removed from the plug-receiving cavity.

Figure 7:
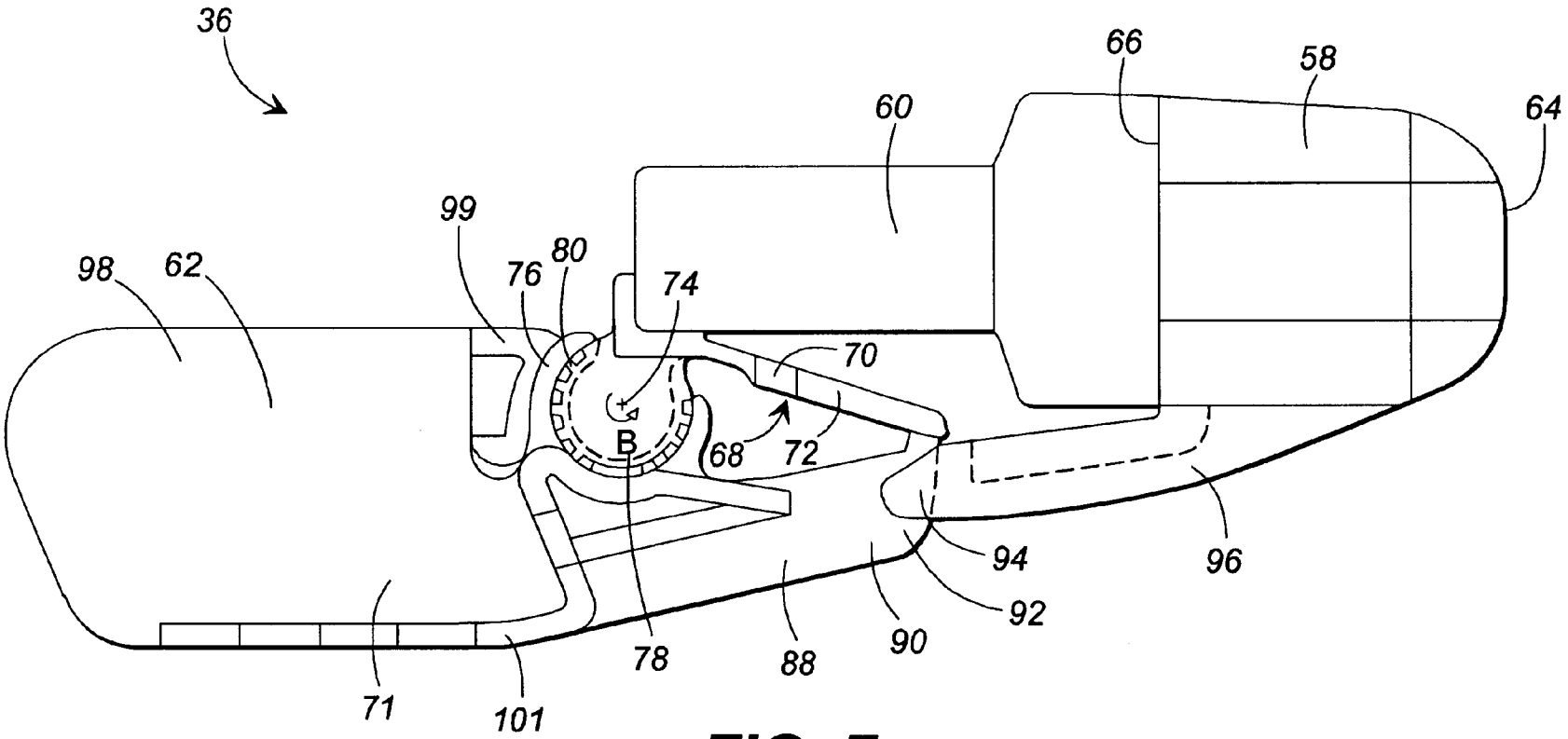
FIG. 7 is a partially cut-away, side view of an alternative embodiment of a patch cord plug.
Figure 8:
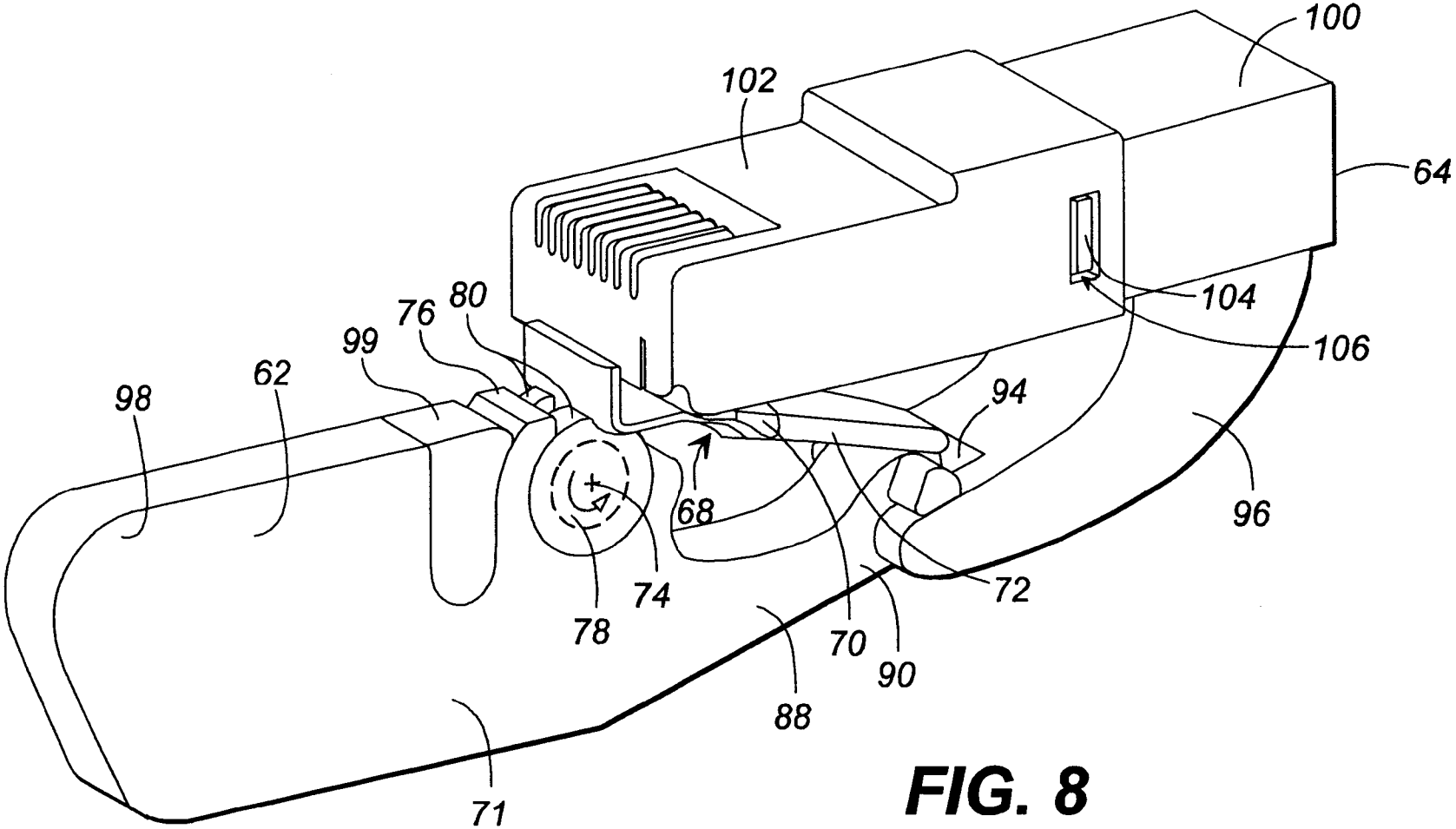
FIG. 8 is a perspective view of an alternative embodiment of the patch cord plug.
Figure 9:
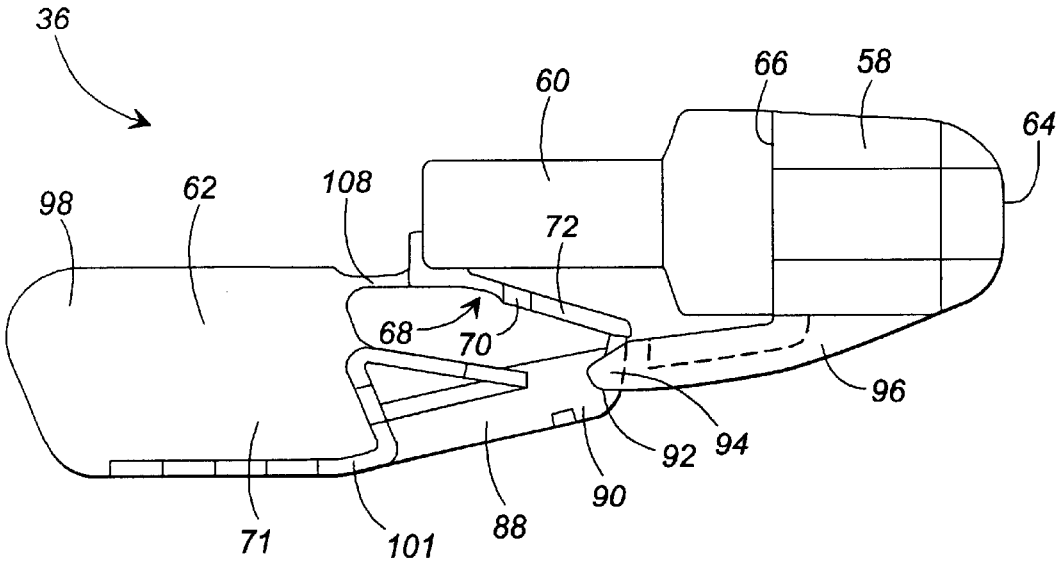
FIG. 9 is a partially cut-away, side view of an alternative embodiment of a patch cord plug.
Figure 10:
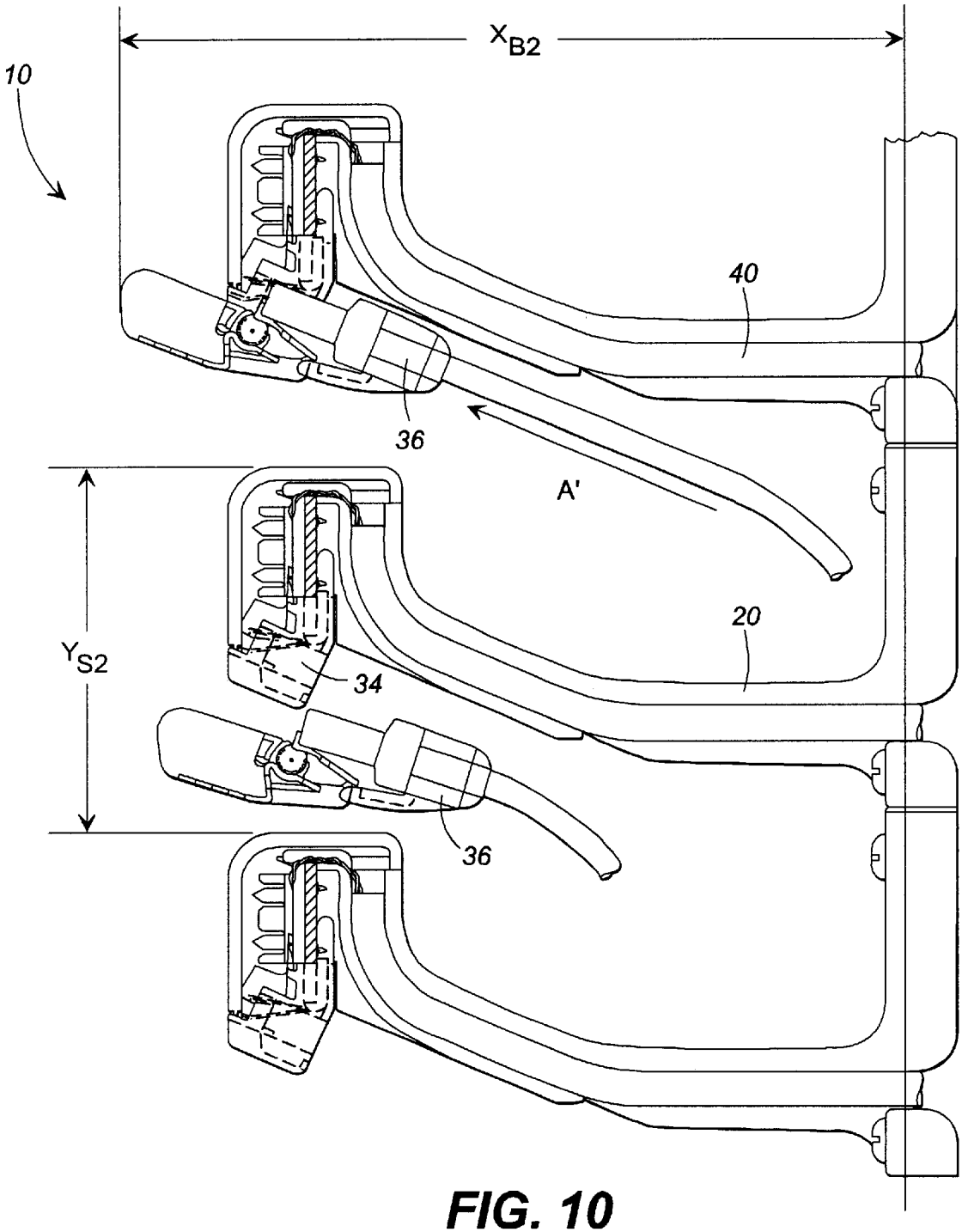
FIG. 10 is a partially cut-away, partially cross-sectional, side view of an alternative embodiment of the patch panel of the present invention.

As shown in FIGS. 7–9, alternative embodiments of plug 36 incorporate an extended handle or key 98 at the distal end of lever 62. The key 98 preferably extends beyond the front of patch panel 10 (i.e. FIG. 10) when plug 36 is engaged within the plug-receiving cavity of a jack of the patch panel, thereby providing convenient access for plug insertion and removal. These extended-handle embodiments also can accommodate a reduced spacing ($Y_{s2}$) between rows of brackets 20 as compared to the embodiment of FIGS. 3 and 6 (i.e. approximately 2.625 inches versus approximately 3.2 inches per row). This is primarily due to the ability of a technician to grasp and manipulate the lever 62 without the technician's hand being placed between the rows of brackets 20.

As shown in the embodiments of FIGS. 7 and 8, a locking clip 99 is provided adjacent bearing 76 for preventing lateral deflection of bearing 76 in response to manipulation of the lever. The locking clip is preferably formed of molded plastic and, in some embodiments, snap fastens to lever 62. Likewise, lever 62 preferably incorporates reinforcing ribs 101 (FIGS. 7 and 9) for preventing lateral deflection of the key in response to manipulation. The ribs 101 also can include a series of steps which extend outwardly at varying heights from the side walls 71.

As shown in FIG. 8, some embodiments of the plug incorporate a strain relief housing 100 which snap fastens to jack interface housing 102. This is accomplished by a set of tabs 104 which displace inwardly as the strain relief housing is inserted into the jack interface housing. The tabs 104 then resiliently return to their pre-displaced positions as the tabs engage and securely seat within a corresponding set of orifices 106 of the jack interface housing, thereby locking the strain relief housing and the jack interface housing together.

Some embodiments of the plug 36 (FIG. 9) incorporate a flexible section 108, versus an axle and bearing combination, for providing the lever 62 with the ability to pivot. As shown in FIG. 9, section 108 spans between key 98 and jack interface housing 60 (preferably at the base of latch 68).

Figure 11:
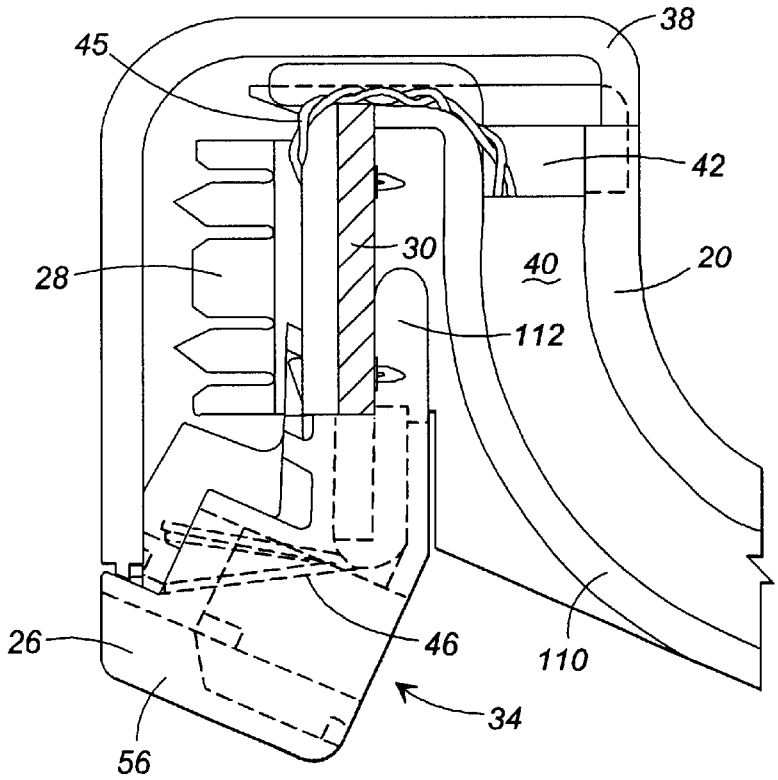
FIG. 11 is a partially cut-away, partially cross-sectional, side view of the embodiment of FIG. 10, showing detail of the jack rack assembly.

In FIG. 11, detail of an alternative embodiment of a jack rack assembly 26 (such as utilized in the patch panel embodiment of FIG. 10) is presented. Assembly 26 cooperates with an array frame 110 which attaches the assembly 26 to the bracket 20. Additionally, each jack frame 24 incorporates an extended portion 112 which is disposed between the array frame 110 and PWB 30.

The foregoing description has been presented for purposes of illustration and description. It is not intended to be exhaustive or to limit the invention to the precise forms disclosed. Obvious modifications or variations are possible in light of the above teachings. The embodiment discussed, however, was chosen and described to provide the best illustration of the principles of the invention and its practical application to thereby enable one of ordinary skill in the art to utilize the invention in various embodiments and with various modifications as are suited to the particular use contemplated. All such modifications and variations, are within the scope of the invention as determined by the appended claims when interpreted in accordance with the breadth to which they are fairly and legally entitled.

We claim:

1. A patch panel for mounting to a generally vertical mounting surface and for use in interconnecting transmission media, the transmission media extending from the generally vertical mounting surface, said patch panel comprising:

at least one jack including a front end and a rear end, said jack having a plug-receiving cavity formed therein and an elongated keyway formed therethrough, said keyway communicating with said plug-receiving cavity and extending along said jack from said front end substantially to said rear end of said jack, said jack configured to electrically communicate with a transmission medium; and at least one patch cord having a plug and cordage, said cordage attached to said plug, said plug having a key extending therefrom, said plug sized and shaped to engage said plug-receiving cavity such that in an engaged position said key engages said keyway and said cordage electrically communicates with the transmission medium;

wherein said plug-receiving cavity of said jack is oriented so as to open toward the generally vertical mounting surface and is configured to receive said patch cord plug in a first direction such that in said engaged position said cordage extends from said plug and toward the generally vertical mounting surface.

2. The patch panel of claim 1, wherein said plug-receiving cavity has a bottom wall and said keyway extends completely through said bottom wall so as to divide said bottom wall into two separate portions.

3. The patch panel of claim 1, wherein said jack has a front wall and a rear wall and said keyway extends through said front wall and said rear wall.

4. The patch panel of claim 1, wherein said plug has a latch and lever, said latch movable between a locking position and an unlocking position, said lever movable between a disengaged position and an engaged position such that moving said lever to said engaged position urges said latch to said unlocking position.

5. The patch panel of claim 4, wherein said key forms at least a portion of said lever.

6. The patch panel of claim 4, wherein said lever has a flexible section, said flexible section deformable between an unflexed position and a flexed position, such that in said unflexed position said lever is in said disengaged position, and in said flexed position said lever is in said engaged position.

7. The patch panel of claim 4, wherein said plug has an axle, said lever being rotatable about said axle between said disengaged position and said engaged position.

8. The patch panel of claim 4, wherein said jack has a bottom wall and said lever has protrusions extending therefrom, said protrusions configured to engage said bottom wall such that said protrusions align said plug relative to said plug-receiving cavity.

9. The patch panel of claim 4, wherein said plug has a guide arm extending therefrom, said guide arm having a slot formed therein such that said lever engages said slot.

10. A patch cord for use in a patch panel, the patch panel having at least one jack, the jack having a plug-receiving cavity formed therein, said patch cord comprising:

cordage having a proximal end and a distal end;

a strain relief housing configured to receive one said proximal end of said cordage such that said cordage extends from said strain relief housing in a first direction;

a jack interface housing having a latch attached thereto, said jack interface housing mounted to said strain relief housing and sized and shaped to engage a plug-receiving cavity of a jack, said latch movable between a locking position and an unlocking position such that in said locking position, said jack interface housing is securely retained within a plug-receiving cavity; and a lever mounted to said jack interface housing and being movable between a disengaged position and an engaged position such that moving said lever to said engaged position urges said latch to said unlocking position.

11. The patch cord of claim 10, wherein said lever is rotatably mounted to said jack interface housing.

12. The patch cord of claim 10, wherein the jack has a keyway formed therethrough, the keyway communicating with the plug-receiving cavity, and wherein said lever has a key extending therefrom such that in an engaged position said key engages said keyway.

13. The patch cord of claim 10, wherein said lever has a flexible section, said flexible section deformable between an unflexed position and a flexed position, such that in said unflexed position said lever is in said disengaged position, and in said flexed position said lever is in said engaged position.

14. The patch cord of claim 10, wherein said jack interface housing has an axle mounted thereto, said lever being rotatable about said axle between said disengaged position and said engaged position.

15. The patch cord of claim 10, wherein the jack has a bottom wall, and wherein said lever has protrusions extending therefrom, said protrusions configured to engage the bottom wall such that said protrusions align said jack interface housing relative to the plug-receiving cavity.

16. The patch cord of claim 10, wherein said strain relief housing has a guide arm extending therefrom, said guide arm having a slot formed therein such that said lever engages said slot.

17. The patch panel of claim 1, wherein said plug-receiving cavity of said jack is oriented so as to be at an angle with respect to the generally vertical mounting surface.

18. The patch panel of claim 7, wherein said axle is positioned at a distal end of said plug.

19. The patch panel of claim 14, wherein said axle is positioned at a distal end of said plug.

* * * * *